US005761022A

United States Patent [19]

Rankilor

[11] Patent Number: 5,761,022

[45] Date of Patent: Jun. 2, 1998

[54] ELECTROSTATIC CHARGE POTENTIAL EQUALISER

[75] Inventor: Peter R. Rankilor, Manchester, United Kingdom

[73] Assignee: Statpad Limited, England

[21] Appl. No.: 605,082

[22] PCT Filed: Sep. 9, 1994

[86] PCT No.: PCT/GB94/01965

§ 371 Date: Apr. 9, 1996

§ 102(e) Date: Apr. 9, 1996

[87] PCT Pub. No.: WO95/07598

PCT Pub. Date: Mar. 16, 1995

[30] Foreign Application Priority Data

Sep. 9, 1993 [GB] United Kingdom ..... 9318669

[51] Int. Cl.[6] ..... H05F 3/00

[52] U.S. Cl. ..... 361/214; 361/220

[58] Field of Search ..... 361/212, 214, 361/216–220

[56] References Cited

U.S. PATENT DOCUMENTS

| | | | |
|---|---|---|---|
| 3,416,033 | 12/1968 | Hoover . | |
| 3,711,742 | 1/1973 | Pinkham, Jr. . | |
| 3,780,345 | 12/1973 | Earman, Jr. . | |
| 4,570,200 | 2/1986 | Osada et al. | 361/212 |
| 4,633,364 | 12/1986 | Nakamura et al. | 361/216 |
| 5,073,425 | 12/1991 | Dees, Jr. et al. | 428/48 |

FOREIGN PATENT DOCUMENTS

| | | |
|---|---|---|
| B-19497/92 | 7/1992 | Australia . |
| 8709107 | of 1987 | Germany . |
| WO87/07997 | 12/1987 | WIPO . |

*Primary Examiner*—Jeffrey A. Gaffin
*Assistant Examiner*—Michael Sherry
*Attorney, Agent, or Firm*—Pravel, Hewitt, Kimball & Krieger

[57] ABSTRACT

A static charge equaliser having electrical, physical and dimensional properties such that when interposed between two bodies having different electrostatic charges and which are brought into contact or close proximity, the electrostatic interaction between the two bodies may be affected such that the formation of an undesirable spark between the two bodies is reduced or eliminated, whilst permitting the potential difference between the two bodies to be reduced or eliminated relatively quickly. The static charge equaliser comprises a material having a surface resistivity and/or a volume resistivity and/or dielectric properties such that charge from an approaching charged body is passed through and/or over the equaliser without an undesirable spark discharge.

16 Claims, 1 Drawing Sheet

ELECTROSTATIC CHARGE POTENTIAL EQUALISER

BACKGROUND OF THE INVENTION

1. Field of the Invention

This invention relates to the controlled reduction of electrostatic potential difference between bodies.

The build up of static electricity is a problem in many different situations, particularly in the office, car, hotel, hospital, home and factory. The problem is often exacerbated by the use of synthetic materials—for example in carpets and furnishings, belting and textiles, in clothing and footwear and in machinery such as lifts and escalators. The problem is particularly evident in certain machines such as textile machines where synthetic fibres can generate static charges.

2. Description of the Related Art

The problem can be aggravated by air conditioning and conditions of low humidity in general.

People working in such environments acquire and build up a high voltage static charge on their persons. Objects in such environments can also acquire undesirable charge. When objects and/or persons having substantially unequal potential come into very close proximity, the local electric field can exceed the electrical breakdown strength of the air, leading to an undesirable discharge which is generally in the form of an air-gap spark.

One annoying and potentially dangerous manifestation of the problem is the personal shock experienced when such a charged person approaches and touches a door handle, say, or a filing cabinet or other piece of office equipment. The shock is due to a spark discharge across the narrowing air gap as the hand or other part of the body approaches the item in question. The discharge may be heard and may actually be seen in a darkened room. The shock is often quite painful and a reflex reaction from it can—especially with moving machinery—cause the hand or other part of the body to suffer some contingent injury.

Damaging discharges can also take place from charged personnel or objects at relatively low voltage. Such discharge, at voltages as low as 50 volts potential difference, or even less, can damage semiconductors and sensitive electronic devices and are so small that they are usually not detectable by humans in terms of pain or being an observable discharge of any kind. Electrostatic discharges produce associated magnetic and electromagnetic radiation which can be disruptive to nearby or remote electronic equipment in addition to damage which might be caused by direct current flow.

Static is a known problem in many industrial operations inasmuch as it interferes with the operations themselves. In the case of synthetic yarn processing, charges an the running yarn or on fibres can seriously interfere with such operations as warping, spinning, carding and texturising as a result of mutual repulsion between adjacent running threads or the filaments of a multi-filament yarn or by the build up of fibres on machinery parts by electrostatic attraction. When machinery containing charged fibres is temporarily stopped, the fibres can cling adversely to adjacent surfaces, thus preventing the successful restart of the machine. Furthermore, the large size of industrial equipment means that static discharges are potentially dangerous and can even be fatal.

Many ways of preventing static build up have been proposed. In general, they fall into three categories.

Firstly, they can involve non contact procedures, such as the production of an electrical field to ionize air molecules which facilitate the conducting away of the electrostatic charge. However, such methods themselves may give rise to hazard because of the high potentials which are sometimes used to ionise the air. Such equipment is expensive to purchase and some requires a continuous electricity supply to operate.

Secondly, they can involve the use of astatic materials (i.e. those which have a low separation of charge when rubbed), to prevent the creation and consequent build up of static charge.

Thirdly, they can involve the continual dissipation of static, for example, by large bench mats, floor mats, conductive comets or work coats, as static is generated. This includes both earthing through and static dissipation within large area mats. For this purpose, workstation grounding systems are available comprising relatively large floor and table mats of dissipative material, which are used in connection with special grounding accessories to dissipate charge as it is generated. The general principle is to create a non-static area for working. Within such an area, wrist straps are available for grounding personnel undertaking critical operations such as, for example, servicing electronic equipment, where rapid static discharge could destroy or degrade components on circuit boards.

The present invention is based on the discovery that a very small quantity of equalising material can be used in a small discrete form, to reduce in a controlled fashion static charge inequalities between differently charged persons and/or objects, thus preventing the occurrence of an undesirable spark. Controlled and planned 'grounded' environments are necessary in special situations such as electronic handling areas, but for general office purposes, the use of equalisers provides an alternative to adopting an unrealistic 'controlled' situation. By utilising equalisers, personnel are free to move about their environment and can safely dispose of built-up charge elsewhere, as required.

The term "equalise" means to reduce an inequality of potential towards the state of equality without necessarily achieving equality.

SUMMARY OF THE INVENTION

The invention comprises, in one aspect, a static charge equaliser having electrical, physical and dimensional properties such that when interposed between two bodies having different electrostatic charges and which are brought into contact or close proximity, the electrostatic interaction between the two bodies may be affected such that the formation of an undesirable spark between the two bodies is reduced or eliminated, whilst permitting the potential difference between the two bodies to be reduced or eliminated relatively quickly.

This invention can thus be used to permit charged persons to relieve themselves of their acquired charge or to reduce their charge difference with other objects or persons before coming into direct contact with them.

The terms "undesirable" and "undesirable spark" are intended to encompass and include the following types of discharge;

Sensible discharge or Sensible spark, namely one that, in the case of static discharges between charged or uncharged persons, and differently charged objects or other people, is sufficiently powerful to cause a physically observable or painful sensation.

Damaging discharge or Damaging spark, namely one that in the case of static discharges between persons and objects or objects and objects is sufficiently powerful to cause damage by current passage or by magnetic or electromagnetic radiation generation. This encompasses low voltage discharges which may not be observable or sensible by humans.

Incendive discharge or Incendive spark, namely one that is sufficiently powerful to cause ignition of a solid, liquid, gas or vapour.

The terms "undesirable" and "undesirable spark" therefore include sensible, damaging and incendive discharges.

High static charges built up on the person are usually discharged by a spark which is felt as a painful sensation in addition to being heard. The spark is generated as the air gap between the person and the object decreases to the point where the voltage difference can overcome the resistance of the remaining small air gap and thus drive an electric current across. The shock is thus apparently experienced on contact with the object, but may in reality be experienced just before contact with the other surface.

Such discharges are controlled according to the Invention by the action of the equaliser eliminating the undesirable spark, although some sensation may well be felt by sensitive people, though not a painful sensation, or as painful a sensation as without the equalizer, and although some audible effect—usually a brief hissing noise—may well be manifest. Such an effect indicates that a desirable discharge or charge equalisation has in fact taken place.

The equaliser (unlike large conventional static dissipating mats and work surfaces on which static sensitive equipment such as computers may be placed and which operate to continually dissipate static as it is generated via grounding accessories to earth) may be of small physical size in relation to the two charged bodies and can perform its function between persons or objects which may have acquired adverse charge on more than one occasion or continually over a period of time.

The equaliser may take the form of a pad, liquid, coating, paint, or powder and its dimensions may be small in relation to those of the objects or persons whose charges are being reduced or equalized. In a practical instance, an equaliser may be as small as one centimeter in diameter, only sufficient to accommodate the placing of a finger tip upon it. Before performing its function, the equaliser may be in prior contact with either or neither of the dissimilarly charged objects/persons/surfaces.

The equaliser may also have only a small charge capacity in relation to the two objects/persons/surfaces being discharged or charge-equalised.

The invention comprises, in another aspect, a static charge equaliser comprising a material having a surface resistivity and/or a volume resistivity and dielectric properties such that charge from an approaching charged body is passed through and/or over the equaliser without an undesirable spark discharge.

The surface resistivity of the material may be in the range $5\times10^{8}$ to $5\times10^{13}$ Ohms preferably $1.5\times10^{9}$ to $1.2\times10^{13}$ Ohms.

The volume resistivity of the material may be in the range $4.9\times10^{8}$ to $1.28\times10^{10}$ Ohm cm.

The permittivity of the material at 104 Hz may be In the range 2.2 to 9.3 at 103 Hz may be in the range 2.9 to 13.5 and at 102 Hz may be In the range 3.6 to 17.7.

The equaliser of the invention may be in the form of a pad of the material adapted for attachment to a charged, uncharged or earthed surface, for example, by having an adhesive under-surface, or by use of a piece of double sided adhesive tape. The adhesive may or may not completely cover all, part, or none of the contact area between the material and the "ground" object. In some cases adhesive would be unnecessary.

By "ground" here is not necessarily meant a connection to earth, rather to an earth equivalent such as a conducting body into which the charge of another body may flow to reduce or equalize their relative potentials.

The equaliser, for many purposes, need only be of fingerprint size and can be readily applied wherever and whenever required. A pad, for example some 20 mm×12 mm×2 mm with an adhesive covering half of one surface by which it may be applied, for example, to a metal filing cabinet or a metal door handle—leaving part of the material to have direct contact with the metal—is unobtrusive but very effective in the controlled reduction of personal static before physical contact is made with the metal.

A larger palmprint size equaliser of similar or greater thickness can be used in machinery or plant where a smaller device may not be readily visible or where voltage/charge may be sufficiently high to require the elimination of risk of missing the equaliser.

In addition to such use as a personal/personnel static equaliser, the material may be used in plant and machinery to help safely dispose of charge built-up on stationary or moving parts or materials.

Certain synthetic plastics materials are particularly suited for carrying out the invention. A material based on polyvinylchloride polymer and containing a quaternary ammonium compound as antistatic agent has been found to give very good results, with loadings of antistatic agent in the range 2–6 parts per hundred of resin. Another polyvinylchloride based polymer containing polyethylene glycol also performed very well. This material was found to give very good results when used under conditions of low humidity. This is an important benefit, since some materials are prone to loss of performance as humidity falls and lack of humidity tends to lead to the build up of undesirable static in office and similar environments. This material worked well in an arid environment even when the equalizer was of small, fingertip-size dimensions.

Equaliser pads have been successfully used with full adhesive cover between the pad and the surface to which it is attached. There is no absolute requirement for a certain direct contact of equaliser to the surface. This depends on the type and thickness of the adhesive. The adhesive must be compatible with both the dissipative pad material and the surface onto which it is to be mounted.

The equaliser may generally be in one of three forms:

It may be provided attached to an object at the time of manufacture, such that a person or another object may approach it for dissipation purposes. (Painted, dipped or sprayed surface, coated handles, coated buttons, coated switch surrounds, etc.) Fully coated surfaces would be particularly advantageous in hazardous environments such as mines, electronic equipment areas, gas plants, petroleum plants, chemical storage areas, areas where explosives are being handled, or laboratories where solvents are used.

It may be provided in pack or individual tab form, such that it may be attached on an ad-hoc basis to such surfaces as may require its function. (Small tabs or pas with adhesive peel-off backing, strips with adhesive backing, spray cans for individual application, etc.)

It may be provided to persons, to wear or carry in such a way that they may utilise it by holding, or otherwise applying the material briefly In contact with a surface before touching it.

There is some evidence that use of the equaliser in one form or another can act to discharge static charge induced onto an ungrounded body by the passage of another body (in the case of moving machinery, for example, a moving part may pass by an insulated metal part) or by other electrical or electromagnetic means. The presence of equalizer material between the two parts or at a different point, but acting upon the insulated component, may act to discharge the induced potential, thus preventing the long-term build up of charge on the insulated part. Similarly, there is some evidence that the equaliser can reduce static potential between bodies without direct contact with one or both of the bodies.

In the case of personnel static problems, people acquire potential relative to fixtures and fittings that are differently charged, and since all that is required is contact (or close proximity) between the person and a "ground" through the intermediary of the equaliser, it is perfectly possible for the person to carry an equaliser and interpose it or otherwise utilise it as required in order to discharge his/her static build up without the generation of an undesirable discharge—especially a sensible spark. A portable equalizer can, for example, take the form of a thimble, a conductive propelling pencil with an equalising plastic end cap, equalising nail varnish, a tissue/handkerchief, a ring worn on the finger, or a personal spray.

An equalising material could be used as an end cap or pad fitted to the end of a writing implement, provided the implement was itself conductive. A key, for example for a drawer of a filing cabinet, may have an equalising grip, or a key-like device, a dummy key, for example, adapted to be carried on a key ring, may have a metal shank with an equalising grip. A key ring itself may be fashioned wholly or partly of equalising material. Alternatively, the key ring may be provided with a fob of equalising material. The material or pad may also be incorporated on other personal articles, e.g. an article worn by or attached to the person for example around the wrist or neck.

BRIEF DESCRIPTION OF THE DRAWINGS

Embodiments of static charge equalisers according to the invention will now be described with reference to the accompanying drawings in which.

DESCRIPTION OF THE PREFERRED EMBODIMENT

The drawings illustrate static charge equalisers comprising pads 11 of a material having a surface resistivity and/or a volume resistivity and dielectric properties such that charge from an approaching charged body is passed through the equaliser without any undesirable spark being generated.

A suitable material for the pads 11 is polyvinylchloride with or without plasticiser (e.g. a phthalate plasticiser such as bis-(2ethylhexyl) phthalate in an amount around 45% by weight, without or substantially without any filler material (an inorganic filler content of about 1% gives good results) and 2 to 6% (by weight of resin) of an antistatic agent which may be a quaternary ammonium compound or polyethylene glycol.

Figure 1:
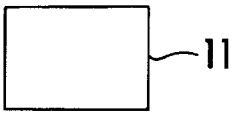
FIG. 1 is a front view of an equaliser pad
Figure 2:
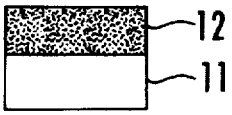
FIG. 2 is a back view of the pad of FIG. 1
Figure 3:
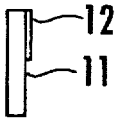
FIG. 3 is a side elevation of the pad of FIGS. 1 and 2
Figure 4:
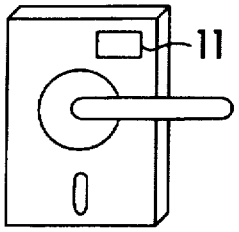
FIG. 4 is a view of a pad in place on a door handle
Figure 5:
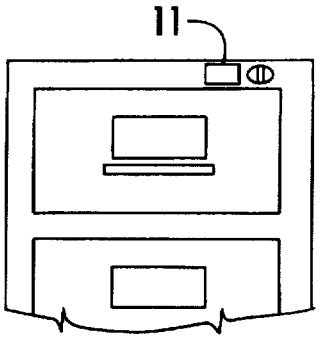
FIG. 5 in a view of a pad in place on a filing cabinet
Figure 6:
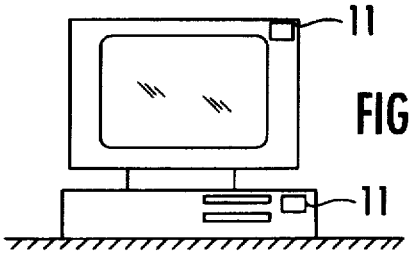
FIG. 6 is a view of pads in place on a personal computer

A fingerprint size pad 11 such as is illustrated in FIGS. 1 to 3 and shown in use in FIGS. 4 to 6 is very effective in an office or domestic environment. To the back of the pad 11 is attached a piece of double-sided adhesive tape 12 by which it may be attached to a surface. The tape 12 only covers half of the back of the pad, thereby allowing direct contact between pad 11 and surface. Any static charge built up on the person is discharged safely to the object to which the pad is attached without any sensation of shock. If the pad is on a sensitive device such as a computer, keyboard or computer peripheral device, the pad safely controls the electrostatic discharge, thus helping to prevent damage to the device. By preventing a damaging spark from being generated, the equaliser can prevent damage to equipment remote from the immediate point of dissipation caused by magnetic or electromagnetic radiation or induced currents.

In the case of high static potential build up which would normally result in an undesirable spark, the dissipation may be heard as a slight rustling sound, which confirms that a desirable discharge or potential reduction has taken place. In any event, touching the pad provides a safe and painless way of equalizing potential before the object proper is touched.

Figure 7:
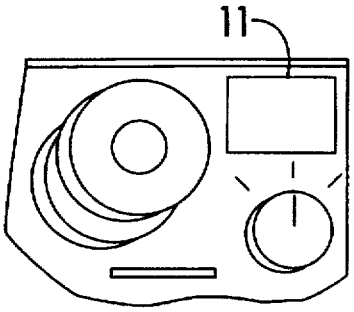
FIG. 7 is a view of a larger pad in place in a machine environment

The larger palm-sized pad 11 illustrated in FIG. 7 is no more or less effective than the smaller finger print sized pad of FIGS. 1 to 6, but is more visible in a cluttered machine environment and reduces the chance of missing the pad through clumsiness, lack of concentration, or lack of time, thus improving safety. Although this larger sized pad can be safely and painlessly touched exactly as the fingerprint sized pad, it may be sufficient just to bring the hand into close proximity.

Figure 8:
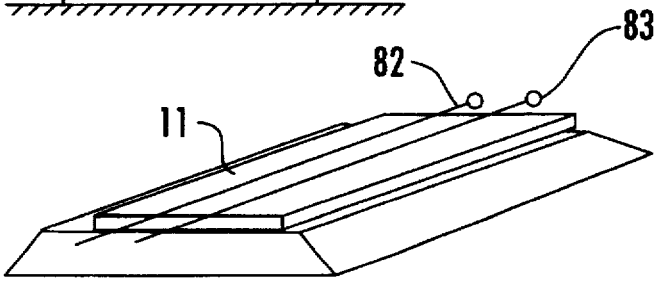
FIG. 8 is a view of equaliser in a textile thread processing machine

FIG. 8 illustrates an equaliser pad 11 secured as by adhesive around its edge to a grounded metal surface 81 of a textile thread processing machine. A textile thread 82 which would normally be highly charged as a result of rubbing other parts of machine is safely and effectively discharged by running in close proximity to the pad 11. The thread 82 could actually be in contact with the pad 11 and this would be very effective but may give rise to wear of the pad. Rollers over which threads run could, of course, be covered with the material and metal or, ceramic components such as thread guides 83 could be coated with and/or mounted on pads of the material.

Figure 9:
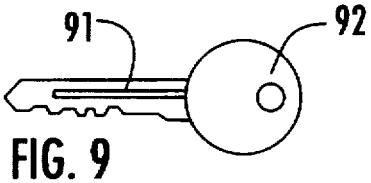
FIG. 9 is a view of a key or key-like device
Figure 10:
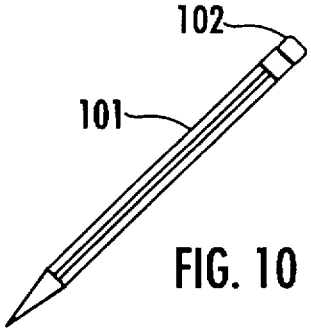
FIG. 10 is a view of a metal propelling pencil fitted with an equalising tip

FIG. 9 illustrates a key 91, for example for a door or filing cabinet, with a dissipative grip 92, whilst FIG. 10 illustrates a propelling pencil with conductive metal body 101 and an end-mounted pad/eraser 102 of equaliser material.

Figure 11:
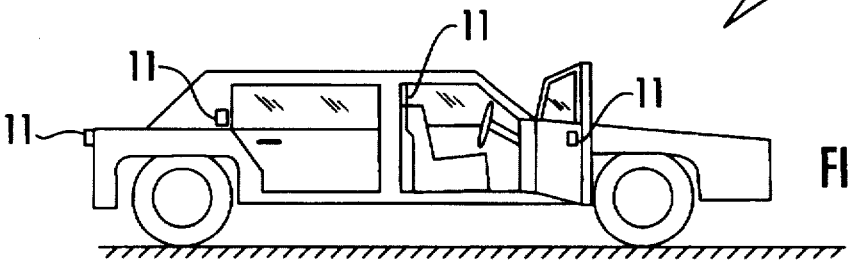
FIG. 11 is a view of a car with equalisers placed in optional positions.

FIG. 11 illustrates equaliser pads 11 souse of which have been attached internally and some externally so that occupants or people having left the vehicle can touch them prior to making contact directly with the metal or paintwork of the vehicle.

The following table summarises the properties of two materials, M1 and M2, found to be effective and compares them with three materials found unsatisfactory. It may be of interest that M1 was subjectively judged better than M2.

| Material | Volume Resistivity Ohm cm | Surface Resistivity Ohm | Permittivity 104 Hz | 103 Hz | 102 Hz |
|---|---|---|---|---|---|
| M1 | $1.4–6.9 \times 10^{9}$ | $1.5 \times 10^{9}–7.7 \times 10^{12}$ | 3.4–9.3 | 4.5–13.5 | 5.5–17.7 |
| M2 | $0.97–1.28 \times 10^{10}$ | $3.5–12.1 \times 10^{12}$ | 2.9–4.4 | 3.4–5.1 | 3.8–5.7 |
| Four D Rubber S (Black) | $2.5–3.0 \times 10^{13}$ | $8.0–8.6 \times 10^{13}$ | 2.0–2.1 | 2.1–2.2 | 2.2–2.3 |
| GPC-NEOP T280 (Black) | $7 \times 102–5 \times 10^{4}$ | $1.9 \times 10^{3}$ | 572 | 1267 | Off scale |
| Polyethylene unspecified (Black) | $4.4–6.1 \times 10^{16}$ | $1.8–>1.9 \times 10^{15}$ | 1.9 | 2.2 | 2.4 |

M1 is a yellow translucent polyvinylchloride material with 46.8% of a phthalate plasticiser and 1% of an inorganic filler; M2 is an orange polyvinylchloride material with 43.9% of a phthalate plasticiser and 0.84% of inorganic filler, all by weight.

The basic operation of the invention is to remove electrostatic charge from a person by brief finger tip contact with a suitable material placed in contact with an earth surface so that subsequent direct contact with that earth surface will not produce a painful electrostatic shock.

An "earth surface" means a surface grounded to or a surface at a lower potential than the person and of sufficient charge capacity to be able to accept a painful discharge on skin contact if not connected to ground or poorly grounded.

As an example, the person may become electrostatically charged by walking across a carpet and the earth surface could be a filing cabinet.

Alternatively, the finger tip can be in position on the material, or connected to it, and brief contact made between the material and the earth surface in order to achieve the same result. It will be appreciated that although finger tip contact is generally convenient, other skin contact for the same purpose would be in the scope of this invention.

The invention also enables an earth surface that gives rise to electrostatic shocks to be used as a convenient discharge point for electrostatically charged personnel in order to avoid electrostatic shocks from nearby surfaces, where the material cannot be or has not been positioned.

The present invention does nota to prevent people from becoming electrostatically charged-up as a way of avoiding ad hoc discharges, as required for example to protect sensitive electronic components. Nor does the present invention aim to prevent electric shock.

However, it is a further objective of this invention to provide for controlled personal electrostatic discharges and thereby reduce the danger associated with the large and rapid ad hoc discharges that are typically associated with painful static shocks.

The prevention of electrostatic build up on personnel or equipment can be achieved by providing continuing contact to electrical ground i.e. earth. That contact may be via floor or bench-top mats, the electrical resistance of the mat generally being above a minimum level in order to prevent the risk of electrical shock to personnel working with electrical equipment.

In contrast, this invention relates to ad hoc electrical contact between person and an object providing an earth surface, with a specific requirement for brevity of contact with the material of the invention, with the objective of avoiding a painful electrostatic discharge both on initial contact with the material of the invention and on subsequent contact with the earth surface itself.

It has been discovered that the above requirement and objective can be met by using materials whose electrical resistance falls within a specified range.

It is convenient to use the material in the form of a pad, typically 3 mms thick and 25 mms×25 mms square, and a practical assessment of the suitability of a given material in this general for is achieved by measuring its electrical resistance as follows.

Using a commercial ohm meter, a voltage of 1,000 volts is applied across the sample, the resistance being measured between the end of a 6.3 mm diameter conductive metal rod (preferably made of copper or brass), placed in intimate contact end-on against one side of the sample, and an earthed metal plate in intimate contact with the sample on its reverse side.

This test aims to simulate the practical situation of the flow of charge from a small area contact with a pad of the material. The resistance may also be calculated using the same electrode array to apply the required voltage and then measuring the current.

The above array can also be used to confirm that the candidate material at the available thickness is able to withstand voltages of up to 20 kV without electrical breakdown. This is an important consideration, particularly if thin pads are envisaged.

Using the above method for measurement of electrical resistance, suitable materials are found to have a resistance in the range of $10^{5}$ to $10^{10}$ ohms, the preferred range being $10^{6}$ to $10^{9}$ ohms. It will be appreciated that the thickness of the pad will have an affect on the overall resistance measured, and this can to a certain degree be used to tailor the effectiveness of the pad, bearing in mind the requirement for the pad to be able to withstand the high voltages it may be subjected to, as high as 10 kV and in some cases as high as 20 kV.

Also, given that the electrical breakdown strength of the air is about 3 MV per meter, such high voltages can lead to breakdown through the pad if there are any small holes present in the material.

Overall, therefore, 6 mms is considered a prudent thickness for a pad of the present invention, with 2 mms being a more convenient working thickness if the material will allow. Nevertheless, thinner pads can be used with care. It will be appreciated that there will generally be limitation on the maximum thickness of material used related to practical consequences, such as space available for locating and using the material, and matters of convenience.

With respect to the cross sectional area of the material presented for skin contact, it is prudent, generally speaking, that this be greater than 6 $cm^{2}$, assuming a simple square pad shape. This is to ensure that there i a sufficient contact area for a finger not to overlap the edge of the pad, which could lead to an undesirable discharge, depending on the thickness of the pad. The design of the pad should therefore accommodate a range of finger sizes so that a finger can, If necessary, be placed on the pad quickly and conveniently, without great precision.

A further reason for not substantially reducing the cross-sectional area of the pad is to avoid any high voltage breakdown across the surface. Nevertheless, small area pads can be used with care if the material is known to be stable at high voltages and the finger is placed carefully.

In experiments a static shock unit operating up to 10 kV has been used to generate a range of electrostatic shocks, the severity of which can then be compared to those that occur naturally. The results indicate that many electrostatic shocks typically experienced as painful occur in the range of 5–9 kV, which can be met by materials towards the middle of the resistance range.

Higher voltages, which can result in very painful shocks, or more sensitive people, are accommodated by increasing the resistance of the pad within the preferred range, generally without the contact time exceeding 1 second. Lower voltages, which result in less painful shocks, can be met by decreasing resistance values. The latter pads however will give shocks if used at higher voltages than anticipated in their design.

It should also be recognised that if a material has a non-linear current-voltage curve, then care should be taken if the resistance falls at high voltages, to ensure that the lowest resistance encountered does not lead to a shock on first contact with the pad. It is preferable although not essential that the resistance value should not vary by more than 50% of the higher value measured.

Given that the voltage generated is a complex function of several variables, and the exact degree of pain expected at a given voltage is subjective, it is a further objective of the invention to allow for the tailoring of a solution either to meet specific needs or to provide a general level of protection.

By way of example, a pad 2.3 mms thick, 25 mms×25 mms square has been found to provide good protection against voltages up to 10 kV for a wide range of people. This bad a resistance value as measured by the above method, of $12\times10^5$.

The material itself has a volume resistivity of $5\times10^9$ ohm-cm as measured by ASTM D-257. It is generally found that volume resistivities outside the range $10^7$ to $10^{12}$ ohm-cm are unlikely to be useful for the present invention, because they will yield resistance values either too large or too small, taking into account the need for due care in using thin pads already described.

For example, materials referred to in the table above having volume resistivities of $2.5\times10^{13}$ and $5\times10^4$ were both found to be unsuitable for preventing electrostatic shocks. The former gave rise to a shock on touching an earth surface after a brief touch of the material, and the latter gave rise to a shock on first touch of the material itself.

The material of the invention is conveniently, but not necessarily, a polymeric composition that is formulated to be sufficiently conductive and having appropriate additives both to impart the required level of conductivity and also to facilitate processing. Other additives may be required to achieve the desired physical and chemical properties and colour. Advice on these various matters is documented In the Modern Plastics Encyclopedia. However the resistance is achieved, it is important that the material employed is stable under high voltage conditions of up to 10 kV, and preferably up to 20 kV.

It must also be borne in mind that any surface markings or coatings should be checked for their effect on total resistance value. If the material is used as a self adhesive pad, due care should be taken to use the adhesive without excess, or if necessary in such a position on the pad that its effect on total resistance is not adverse to requirements.

If an adhesive layer is applied to the complete under surface of the pad, particularly if applied on a carrier film, then it is important that the adhesive layer and any carrier film break down at the lowest possible potential, preferably below 1 kV, in order to ensure that the pad performs well down to 1 kV.

An alternative method of fixing a pad is to incorporate a magnetic material in its fabrication such that the pad can be attached to and removed from magnetic or magnetizable surfaces without the need for an adhesive.

Brief contact times are a practical requirement for applications such as opening and closing drawers or doors. A further aspect of this invention is to provide a method whereby the contact time can be extended, which may prove to be useful particularly when very high voltages may occur.

In this case the material is provided as a wedge shaped pad, contact with the pad being made at the thickest end, this being followed by a stroke of the finger down the length of the wedge towards its thinner end. The wedge could be in a sequence of descending steps to give a tactile response, as the body potential is being reduced.

I claim:

1. A static charge equaliser having electrical, physical and dimensional properties such that, when interposed between two bodies having different electrostatic charges and which are brought into contact or close proximity, the electrostatic interaction between the two bodies is such that charge is passed between the bodies via the equalizer without the formation of an undesirable spark discharge, whereby the potential difference between the two bodies is reduced or eliminated relatively quickly, the static charge equaliser comprising:

a material having a surface resistivity in the range $5\times10^8$ to $5\times10^{13}$ ohm, a volume resistivity in the range $10^7$ to $10^{12}$ ohm cm, and a resistance as measured by the test method hereinbefore defined in the range of $10^5$ to $10^{10}$ ohms, the static charge equaliser being in the form of a pad or sheet able to withstand voltages of up to 10 kV without electrical breakdown.

2. The static charge equaliser of claim 1, wherein the surface resistivity of the material is in the range $1.5\times10^9$ to $1.2\times10^{13}$ ohm.

3. The static charge equaliser of claim 1, wherein the volume resistivity of the material is in the range $4.9\times10^8$ to $1.28\times10^{10}$ ohm cm.

4. The static charge equaliser of claim 1, wherein the resistance of the material as measured by the test method hereinbefore defined is in the range of $10^6\times10^9$ ohms.

5. The static charge equaliser of claim 1, wherein the pad or sheet has a thickness of not less than 2 mm.

6. The static charge equaliser of claim 5, wherein the thickness of the pad or sheet is not less than 6 mm.

7. The static charge equaliser of claim 5, wherein the area of the pad or sheet presented for skin contact is greater than 6 $cm^2$.

8. The static charge equaliser of claim 5, wherein the pad or sheet is tapered in its thickness dimension.

9. The static charge equaliser of claim 8, wherein the pad or sheet is stepped in the direction of tapering.

10. The static charge equaliser of claim 1, wherein at least part of a rear surface of the pad or sheet is provided with a layer of adhesive so as to permit the pad or sheet to be affixed to an earth surface.

11. The static charge equaliser of claim 1, wherein the pad or sheet is made from a magnetic material, so as to permit the pad to sheet to be affixed to a suitable earth surface.

12. The static charge equaliser of claim 11, wherein the pad to sheet incorporates a magnetic filler.

13. The static charge equaliser of claim 1, wherein the pad or sheet is incorporated in a personal article.

14. The static charge equaliser of claim 1, wherein the pad or sheet is able to withstand voltages of up to 20 kV without electrical breakdown.

15. The static charge equaliser of claim 1, wherein the material is made of a polyvinylchloride material incorporating an antistatic agent.

16. A method of discharging an electrostatically charged user of equipment, comprising the step of:

interposing a static charge equaliser between the user and an electrically conductive surface of said or adjacent equipment, wherein the static charge equaliser comprises a material having a surface resistivity in the range $5\times10^{8}$ to $5\times10^{13}$ ohm, a volume resistivity in the range $10^{7}$ to $10^{12}$ ohm cm, and a resistance as measured by the test method hereinbefore defined in the range of $10^{5}$ to $10^{10}$ ohms, the static charge equaliser being in the form of a pad or sheet able to withstand voltages of up to 10 kV without electrical breakdown.

* * * * *